US005682781A

United States Patent [19]

Schwarze

[11] Patent Number: 5,682,781

[45] Date of Patent: Nov. 4, 1997

[54] METHOD FOR CONTROLLING A PIPE BENDING MACHINE

[76] Inventor: Rigobert Schwarze, Olpener Strasse 460-474, 51109 Cologne, Germany

[21] Appl. No.: 664,666

[22] Filed: Jun. 17, 1996

[30] Foreign Application Priority Data

Jun. 17, 1995 [DE] Germany ..... 195 22 062.5

[51] Int. Cl.[6] ..... B21B 37/08; B21D 7/04; B21D 9/05

[52] U.S. Cl. ..... 72/149; 72/20.1; 72/155; 72/369

[58] Field of Search ..... 72/149, 150, 151, 72/155, 19.8, 20.1, 20.2, 369

[56] References Cited

U.S. PATENT DOCUMENTS

| | | | |
|---|---|---|---|
| 3,303,683 | 2/1967 | Schmidt | 72/155 |
| 4,201,073 | 5/1980 | Eaton | 72/155 |
| 4,970,885 | 11/1990 | Chipp et al. | 72/151 |
| 5,259,224 | 11/1993 | Schwarze | 72/149 |
| 5,343,725 | 9/1994 | Sabine | 72/149 |

FOREIGN PATENT DOCUMENTS 2304838 2/1973 Germany .

*Primary Examiner*—Lowell A. Larson
*Assistant Examiner*—Rodney A. Butler
*Attorney, Agent, or Firm*—Diller, Ramik & Wight, PC

[57] ABSTRACT

For the advance of the slide rail of a pipe bending machine, a hydraulic cylinder (22) is provided. The pressures (P1,P2) on both sides of the piston (23) of the cylinder (22) are detected, and from these pressures, the actual value of the advance force (F) is calculated. A set value generator (49) generates the set value (Fs) of the advance force in dependence on the respective rotational angle (α) of the bending template. A controller (48) controls a throttle valve (42) such that the actual value (Fi) follows the set value (Fs). Thus, a power control of the slide rail advance is effected.

4 Claims, 3 Drawing Sheets

METHOD FOR CONTROLLING A PIPE BENDING MACHINE

BACKGROUND OF THE INVENTION

The invention relates to a method for controlling a pipe bending machine as well as to a pipe bending machine.

When bending pipes, a clamping jaw presses a pipe laterally against a bending template which is then turned together with the clamping jaw. When the bending template is turned, the pipe is bent around the bending template. In the course of this, the unbent pipe section is supported on a slide rail. An advancing device acts upon the slide rail, advancing it during the bending process. The mutual tuning between the turning movement of the bending template and the advance movement of the slide rail is of particular importance. Should the slide rail be advanced too fast or too slowly, cracks, corrugations or oval deformations may occur on the pipe. Further, areas of different wall thickness may develop.

German Patent DE 23 04 838 C2 describes a pipe bending method wherein the turning angle of the bending template and the position of the slide rail are detected. Corresponding to the difference between the upsetting speed and the circumferential velocity of the bending template, an actual value is determined, which is compared with a corresponding set value of the velocity differences. The result of the comparison is fed to a servo valve influencing one of the two hydraulic drives. Thus, a mutual tuning of advance velocity and bending velocity is effected, which are made equal or set to a certain ratio.

U.S. Pat. No. 5,259,224 describes a method for controlling a pipe bending machine which can be referred to as synchronous advance. Here, the turning position of the bending template and the advance position of the slide rail are detected. The thus obtained measured values are compared with each other. The differential value controls a pressure controller changing the pressure to be supplied to the advancing means. If, in such a control method, the actual position lags behind the set position, the acting advance force must be continuously increased to be able to run synchronously. Since, in this method, the flow behavior of the pipe material is not taken into account, there exists the danger of wrinkle formation. A further danger consists in that the slide rail slips on the pipe because the appearing advance force exceeds the frictional force of the slide rail on the pipe surface.

SUMMARY OF THE INVENTION

It is the object of the present invention to provide a control method by which it is possible to gently bend pipes with high precision and dimensional accuracy.

The method according to the invention provides a force control for the advance force with which the slide rail is advanced. With this force control, a set value of the advance force in dependence on the turning angle of the bending template is given, and the actual value of the advance force is controlled in correspondence with the set value. Corresponding to the programmed course of the set value, the advance force of the slide rail is changed in dependence on the present bending angle. The system is particularly suitable for thick-walled pipes and specially for the pressure bending technique, wherein the unbent pipe section is pressed toward the bending template during the bending process. As a result of the special pressure control, a directed influence is exerted upon the force flow within the pipe walls. Variations of the material, its homogeneity and strength only have a very small influence upon the final product. Therefore, ovalness and formation of wrinkles at the bent pipe are also small. This means that the advantages of the control method according to the invention are low wall thickness tapering, low ovalness and low tool wear. As a consequence thereof, it is possible to reduce the pipe wall thickness and thus save material, the strength of the finished pipe being the same. Further, the pipes bent according to the method are excellently suitable for a subsequent hydroformation where a high uniformity of the final product is what matters.

Preferably, the actual value of the advance force is determined by detecting the pressures in the cylinder on both sides of the piston and determining the actual value of the advance force from the pressures, taking the sizes of the two piston surfaces into account. To this end, only pressure sensors at the hydraulic cylinder for the slide rail advance are required. Alternatively, it is possible to incorporate a force sensor into the slide rail advance, thereby, however, the stability of the slide rail advance is reduced.

Suitably, the pressures in the cylinder on both sides of the piston are varied contrary to each other. This means that the counterpressure is reduced in case of an increase in the advance pressure. Thereby, it is possible to completely utilize the maximum pump pressure for the advance.

It is not necessary to perform the method according to the invention from the beginning to the end for a pipe bending process. It is also possible to partially carry out the bending method according to the synchronous method and only in critical regions according to the method of the invention, i.e., by force control.

The invention further relates to a pipe bending machine. Here, a means for determining the actual value of the advance force applied by the cylinder is provided, and there is a controller adjusting the actual value of the advance force in correspondence with a set value generated by a set value generator in dependence on the bending angles supplied by the position sensor of the bending template.

BRIEF DESCRIPTION OF THE DRAWINGS

Hereinafter, an embodiment of the present invention is explained in detail with reference to the drawings, in which.

DESCRIPTION OF A PREFERRED EMBODIMENT

Figure 1:
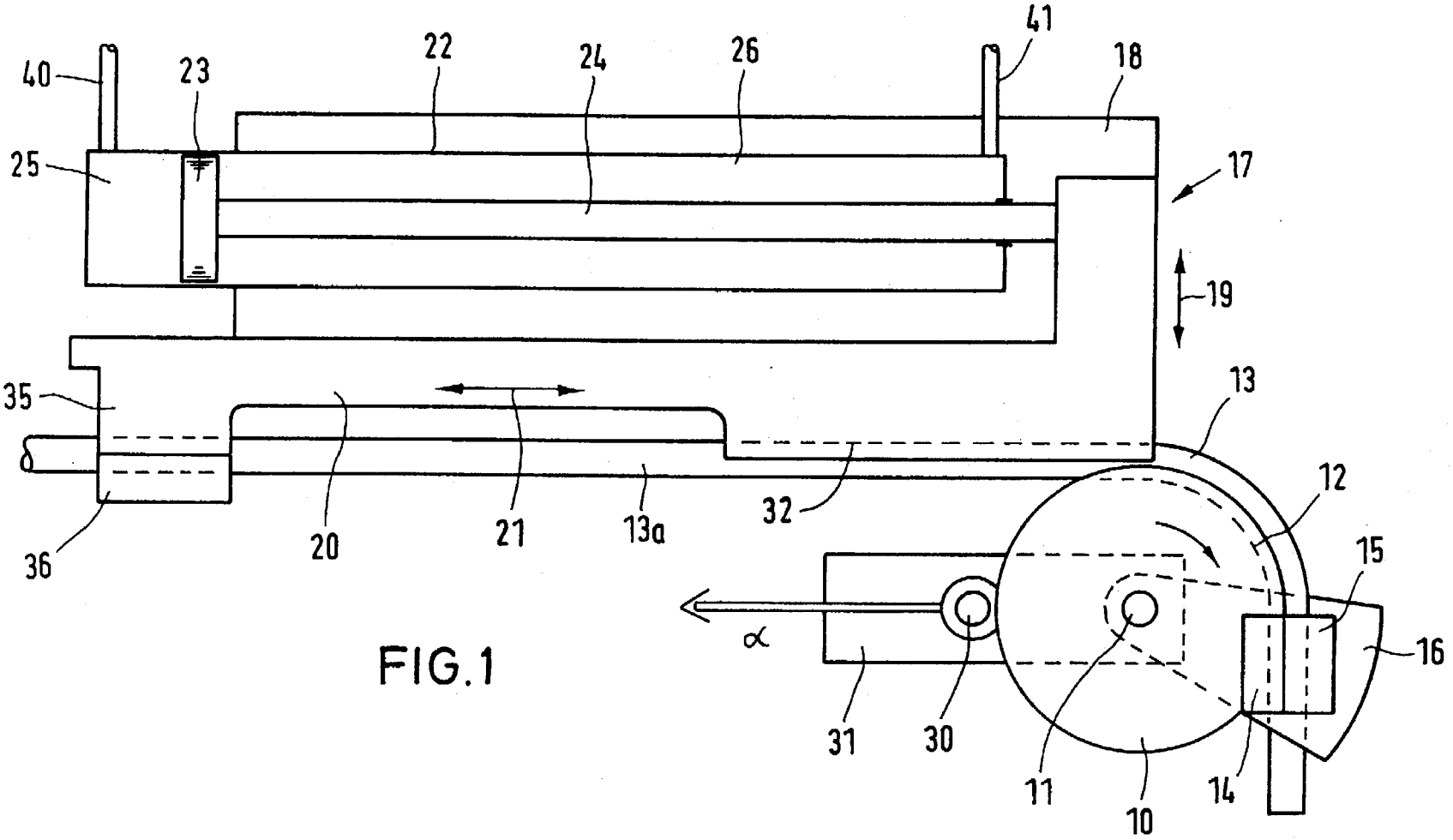
FIG. 1 shows a schematic representation of a pipe bending machine in plan view.

The pipe bending machine diagrammatically illustrated in FIG. 1 comprises a bending template 10 rotatably mounted on a machine table (not illustrated). The bending template 10 provided with a vertical axis of rotation 11 is substantially in the shape of a cylindrical body, the circumferential surface of which is provided with a bending groove 12 that receives about one half of the cross section of the pipe 13 to be bent. A counter clamping jaw 14 is mounted at the bending template 10, with which jaw 14 a clamping jaw 15 cooperates so as to commonly enclose the pipe 13 and to clamp it for the bending operation. The clamping jaw 15 is mounted at a pivot arm 16 pivotable about an axis which coincides with the axis of rotation 11 of the bending template 10. The clamping jaw 15 is radially movable at this pivot arm 16 for clamping or releasing the pipe.

The unbent portion 13*a* of the pipe 13 is supported by a pushing device 17. The pushing device comprises a carriage 18 that is displaceable transversal to the pipe section 13*a* in the direction of the double arrow 19. The carriage 18 bears an under-carriage 20 that is displaceable longitudinal to the unbent pipe section 13*a*, i.e., in the direction of the double arrow 21, as well as a cylinder 22 for moving the under-carriage 20. The cylinder 22 is fixedly arranged at the carriage 18 and in this cylinder, the piston 23 is movable, whose piston rod 24 engages the under-carriage 20 to displace the latter. The cylinder 22 comprises a working chamber 25 and a return stroke chamber 26, separated by the piston 23.

A position sensor 30 is arranged at the bending template 10. The position sensor 30 comprises, e.g., a rotation angle encoder indicating the rotational position of the bending template 10. The bending template 10 is rotated by a (hydraulic) drive 31.

A slide rail 32 is provided at the under-carriage 20 near the bending template 10, pressing against the pipe 13 from the side averted from the bending template and supporting the unbent pipe section 13*a* during the bending process. The under-carriage 20 is further provided with a pushing element 35 engaging the rear part of the unbent pipe section 13*a*. The pushing element 35 may comprise a clamping jaw 36 for firmly clamping the pipe section 13*a*. It is designed such that it engages the pipe without allowing sliding. The pushing element 35 and the clamping jaw 36 are required for pressure bending. If no pressure bending is exerted, the advance force is transferred to the pipe 13 exclusively by the slide rail 32.

In the bending operation, the straight pipe is clamped between the clamping jaw 15 and the counter clamping jaw 14. Then, the bending template 10 is turned according to a predetermined program, the pipe being drawn around the bending template and the straight pipe section 13*a* being moved forward simultaneously. During the bending operation, the under-carriage 20 is advanced parallel to the pipe section 13*a* by the hydraulic cylinder 22.

Figure 2:
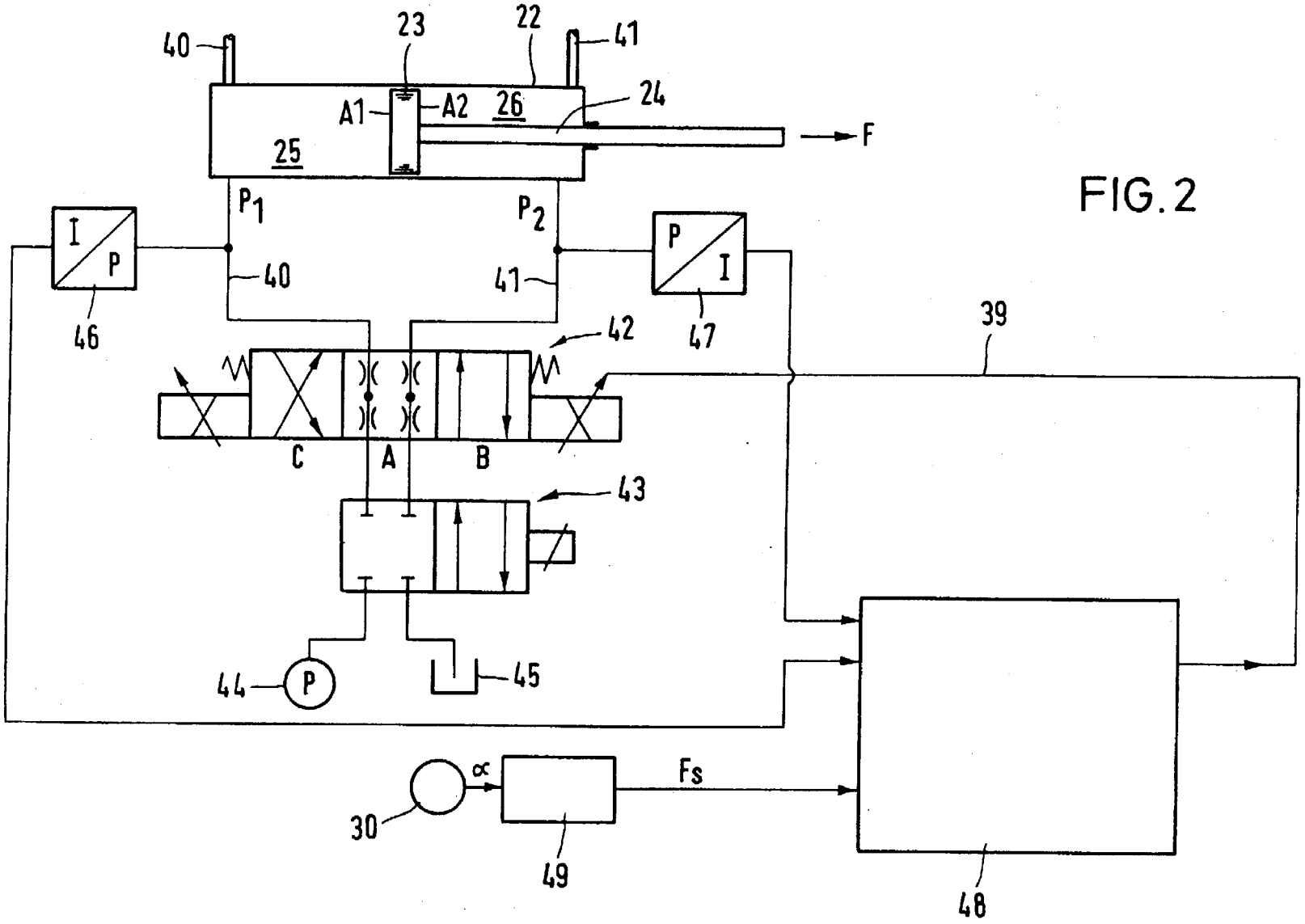
FIG. 2 a block diagram of the slide rail advance control.

According to FIG. 2, the conduit 40 connected to the working chamber 25 and the conduit 41 connected to the return stroke chamber 26 are connected to a control valve 42 which is able to assume three different positions A, B and C. In the illustrated position A, the valve 42 connects the conduits 40 and 41 to a switching valve 43 being connected with a pump 44 and a sump 45 and is adapted to be switched between an admission position and a blocking position. Position B of the valve 42 is for the quick advance and position C for the return stroke of the piston 23.

In position A of the control valve 42, the passages to the conduits 40 and 41 are changed proportionally to the signal of a control line 39. When the signal of the control line 39 is small, the throttle cross section leading to conduit 40 and the throttle cross section connected to conduit 41 are small as well. The greater the signal of the control line 39, the larger becomes the throttle cross section connected to conduit 40 and the larger becomes the throttle cross section connected to conduit 41. In supply and delivery, the throttle cross sections are always the same. The pressures on both sides of the piston are varied contrary to each other.

Conduit 40 has a pressure transducer 46 connected thereto which generates a current signal corresponding to the hydraulic pressure in conduit 40. Conduit 41 has a pressure transducer 47 connected thereto which generates a current signal corresponding to the hydraulic pressure in conduit 41. The outputs of the two pressure transducers 46 and 47 are connected to a controller 48 supplying the control signal for the differential valve 42 through the control line 39. From the pressures within the chambers 25 and 26 and the sizes of the two piston surfaces A1 and A2, the controller 48 calculates the actual value Fi of the advance force acting upon the carriage 20.

Further, the controller 48 is connected to a set value generator 49 supplying a set value Fs of the advance force to the controller 48. This set value Fs of the advance force varies in dependence on the angle of rotation $\alpha$ of the bending template 10 supplied by the position sensor 30.

Figure 3:
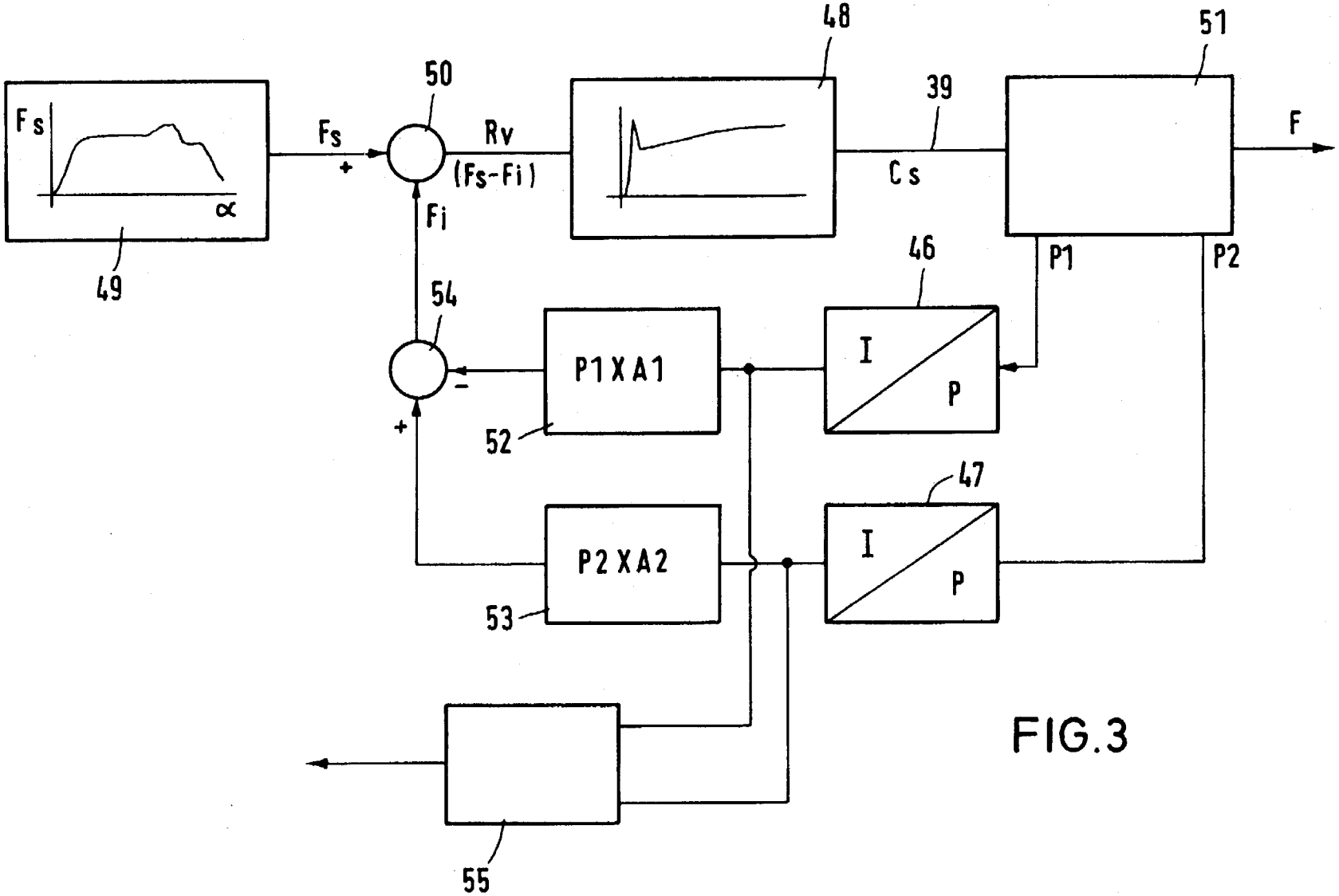
FIG. 3 the control scheme of the slide rail advance.

FIG. 3 shows the control scheme. The set value generator 49 includes several curves indicating the set value Fs of the advance force in dependence on the angle of rotation $\alpha$ of the bending template 10. The respectively desired curve can be selected at the set value generator. Further, the value $\alpha$ for the start and the end of the pipe processing can be inputted at the set value generator. The set value generator 49 supplies, in dependence on $\alpha$, the respectively associated set value Fs from which the actual value Fi is subtracted (Fs-Fi) in a subtracter 50 to generate a resultant value or resultant signal (Rv). The resultant signal (Rv) is supplied to the controller 48 which is, e.g., a PID controller, via the control line 39, and the controller 48 supplies a control signal (Cs) over the control line 39 to the system 51 to be controlled, which here consists of the differential valve 42 and the cylinder 22 (FIG. 2).

The pressure P1 in conduit 40 and the pressure P2 in conduit 41 are supplied to the transducers 46 and 47, respectively. In a multiplier 52, the output signal of the transducer 46 is multiplied by a value corresponding to the size of the surface A1 of the piston 23. In a multiplier 53, the output signal of the transducer 47 is multiplied by a value corresponding to the size of the surface A2 of the piston 23. This means that the multiplier 52 forms the product P1×A1 and the multiplier 53 forms the product P2×A2. Each of these products is a measure for one of the two forces acting upon the piston 23 contrary to one another. A subtracter 54 subtracts the two products from one another, so that the actual value Fi of the advance force is obtained. In the subtracter 50, this actual value is subtracted from the set value Fs to form the input signal to the controller 48.

The output signals of the two transducers 46 and 47 are supplied to an error evaluation means generating an alarm or stopping the pipe bending machine if the pressures P1 and P2 show abnormalities. Total failures of the sensor, e.g., can be indicated as well.

What is claimed is:

1. A method of controlling the operation of a pipe bending machine which includes a rotatable bending template (10), a clamping jaw (15) for pressing a pipe (13) against the bending template (10), a slide rail (32) for engaging an unbent pipe section (13*a*), a piston (23) having opposite piston surfaces (A1, A2) movable in a hydraulic cylinder (22), and a piston rod (24) of the piston (23) being connected to the hydraulic cylinder (22) for advancing the same cooperatively with the rotation of the rotatable bending template (10) through the steps of (a) measuring a respective bending angle ($\alpha$) of the bending template (10), (b) generating from a set value generator (49) a set value (Fs) for an advancement force corresponding to the measured bending angle ($\alpha$), (c) determining an actual value (Fi) of the advance force (Fs) by detecting pressures (P1, P2) in the hydraulic cylinder (22) on opposite sides of the piston (23) in relationship to the sizes of the two piston surfaces (A1, A2), and (d) varying the pressures (P1, P2) in the cylinder (22) such that the actual value (Fi) of the advanced force follows the set value (Fs) of the advanced force.

2. The method as defined in claim 1 wherein the pressures (P1, P2) in the cylinder (22) on both sides of the piston (23) are varied opposite to one another.

3. A pipe bending machine for bending a pipe (13) comprising a bending template (10) rotatable by a drive (33), a clamping jaw (15) for pressing the pipe (13) against the bending template (10), a slide rail (32) engaging an unbent pipe section (13*a*) and being driven by a hydraulic cylinder (22) through a piston (23) thereof, a position sensor (30) for detecting the rotational position through the bending angle (α) of the bending template (10), means (40, 41, 42) for selectively pressurizing the cylinder (22) to move the piston (23) and thereby advance the slide rail (32) in dependency on the signal of the position sensor (30), means (46) for determining the pressure (P1) in the cylinder (22) at a first side (25) of the piston (23), means (47) for determining the pressure (P2) in the cylinder (22) at a second side (26) of the piston (23), means (52) for reflecting the pressure (P1) in relationship to the size (A1) of the piston at the first side (25) thereof, means (53) for reflecting the pressure (P2) in relationship to the size (A2) of the piston at the second side (26) thereof, means (54) for determining the actual value (Fi) of the advance force upon the piston (23) from the last two-mentioned reflecting means (52, 53), means (49) for generating a set value (Fs) in dependence upon the bending angle (α) supplied by the position sensor (30), means (50) for generating a resultant value (Rv) from the actual value (Fi) and the set value (Fs), and controller means (48) for generating a control signal (Cs) from the resultant value (Rv) and therethrough operating said selectively pressurizing means (40, 41, 42).

4. The pipe bending machine as defined in claim 3 wherein said controller (48) controls a control valve (42) having a continuous throttle for varying the pressures (P1, P2) on both sides of the piston (23) opposite to one another.

* * * * *